US010770796B2

(12) United States Patent
Miura

(10) Patent No.: US 10,770,796 B2
(45) Date of Patent: Sep. 8, 2020

(54) ANTENNA DEVICE AND METHOD FOR MANUFACTURING ANTENNA DEVICE

(71) Applicant: Ryutaro Miura, Akita (JP)

(72) Inventor: Ryutaro Miura, Akita (JP)

(73) Assignee: MITSUMI ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/140,079

(22) Filed: Sep. 24, 2018

(65) Prior Publication Data

US 2020/0099137 A1 Mar. 26, 2020

(51) Int. Cl.
*H01Q 1/32* (2006.01)
*H01Q 9/14* (2006.01)
*H01Q 23/00* (2006.01)

(52) U.S. Cl.
CPC ..... *H01Q 9/14* (2013.01); *H01Q 1/32* (2013.01); *H01Q 23/00* (2013.01)

(58) Field of Classification Search
CPC ..... H01Q 1/32
USPC ..... 343/713
See application file for complete search history.

(56) References Cited

U.S. PATENT DOCUMENTS 7,079,079 B2 * 7/2006 Jo ..... H01Q 1/243 343/700 MS
8,421,693 B2 * 4/2013 Ohshima ..... H01Q 1/3275 343/713
9,240,629 B2 1/2016 Kim
9,431,705 B2 * 8/2016 Basirat ..... H01Q 9/42
9,553,365 B2 1/2017 Lindenmeier et al.
10,224,618 B2 3/2019 Ortigosa et al.
2009/0207084 A1 * 8/2009 Ikeda ..... H01Q 1/1207 343/713
2010/0013724 A1 1/2010 Ohshima et al.
2014/0002319 A1 1/2014 Lindenmeier et al.
2014/0340267 A1 11/2014 Kim
2016/0064807 A1 3/2016 Reed et al.
2017/0077596 A1 3/2017 Ortigosa et al.
2018/0261913 A1 * 9/2018 Imamura ..... H01Q 5/335

FOREIGN PATENT DOCUMENTS

CN 201229985 Y 4/2009
EP 3142187 A1 3/2017
JP 5237617 B2 4/2013
WO 2011004636 A1 1/2011

OTHER PUBLICATIONS

Extended European Search Report (EESR) dated Mar. 29, 2019 issued in counterpart European Application No. 18196478.4.

* cited by examiner

*Primary Examiner* — Dameon E Levi
*Assistant Examiner* — Hasan Z Islam
(74) *Attorney, Agent, or Firm* — Holtz, Holtz & Volek PC

(57) ABSTRACT

An antenna device mounted to an automobile includes an antenna component and an amplifier board provided with an amplifier to amplify signals received by the antenna component. The antenna component includes a metal plate and a resonance point adjusting coil having a first end connected to the metal plate, the resonance point adjusting coil being connected to an input terminal of the amplifier board at the first end via the metal plate. The impedance of the antenna component is adjustable by the mount angle of the resonance point adjusting coil to the antenna component.

4 Claims, 9 Drawing Sheets

ANTENNA DEVICE AND METHOD FOR MANUFACTURING ANTENNA DEVICE

BACKGROUND OF THE INVENTION

1. Field of the Invention

The present invention relates to an antenna device and a method for manufacturing the antenna device.

2. Description of the Related Art

Common automobile antenna devices are amplitude modulation/frequency modulation (AM/FM) radio antenna devices capable of receiving AM broadcasts and FM broadcasts. Although AM/FM radio antenna devices of a rod type have been used, AM/FM antenna devices of a shark fin type have been preferred in recent years because of attractive design. The antenna device of a shark fin type is named after its external shape.

Antenna devices of a shark fin have an upper limit of 70 mm in height and an upper limit of about 200 mm in length to comply with legal regulations.

Low-profile antenna devices due to the regulation have disadvantages, such as low impedance or radiation resistance and thus low receiving sensitivity.

For example, Japanese Patent No. 5237617 discloses an antenna device that solves such disadvantages.

The device of Japanese Patent No. 5237617 includes an umbrella antenna component and is called a capacity loaded or top loaded antenna. The feeding point of the antenna component is connected to the input terminal of an amplifier through an antenna coil.

The antenna device disclosed in Japanese Patent No. 5237617 includes the amplifier to compensate for the low reception efficiency in the low-profile antenna component.

However, the low-profile antenna component has low impedance or radiation resistance of the antenna component, resulting in reception loss due to the impedance mismatch between the antenna component and the amplifier.

Although the impedance mismatch can be reduced by providing an additional matching circuit including a resistor, a capacitor, and an inductor on the antenna component, the material and production costs increase.

SUMMARY OF THE INVENTION

An object of the present invention, which has been made in view of the above-mentioned disadvantages, is to provide an antenna device including a coil on an antenna component, where the mount angle of the coil to the antenna component can be modified to adjust impedances without a matching circuit.

According to a first aspect of the present invention, an antenna device mounted to an automobile includes:

an antenna component; and an amplifier board provided with an amplifier to amplify signals received by the antenna component, wherein the antenna component includes a metal plate and a resonance point adjusting coil having a first end connected to the metal plate, the resonance point adjusting coil being connected to an input terminal of the amplifier board at the first end via the metal plate.

Preferably, the resonance point adjusting coil has a second end that is open.

Preferably, the impedance of the antenna component is adjustable by the mount angle of the resonance point adjusting coil to the antenna component.

Preferably, a direction from the first end of the resonance point adjusting coil to the second end along a central axis of the resonance point adjusting coil is vertically downward.

Preferably, the resonance point adjusting coil is mounted at an angle of 90° where a mount angle of the resonance point adjusting coil is defined as 0° when a direction from the first end of the resonance point adjusting coil to the second end along a central axis of the resonance point adjusting coil is vertically downward.

According to a second aspect of the present invention, a method for manufacturing the antenna device includes:

adjusting the mount angle of the resonance point adjusting coil to the antenna device; and adjusting a pitch and a number of windings and a length of a wire of the resonance point adjusting coil according to the angle to adjust an impedance of the antenna component to a desired level.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DESCRIPTION OF THE PREFERRED EMBODIMENTS

Figure 1:
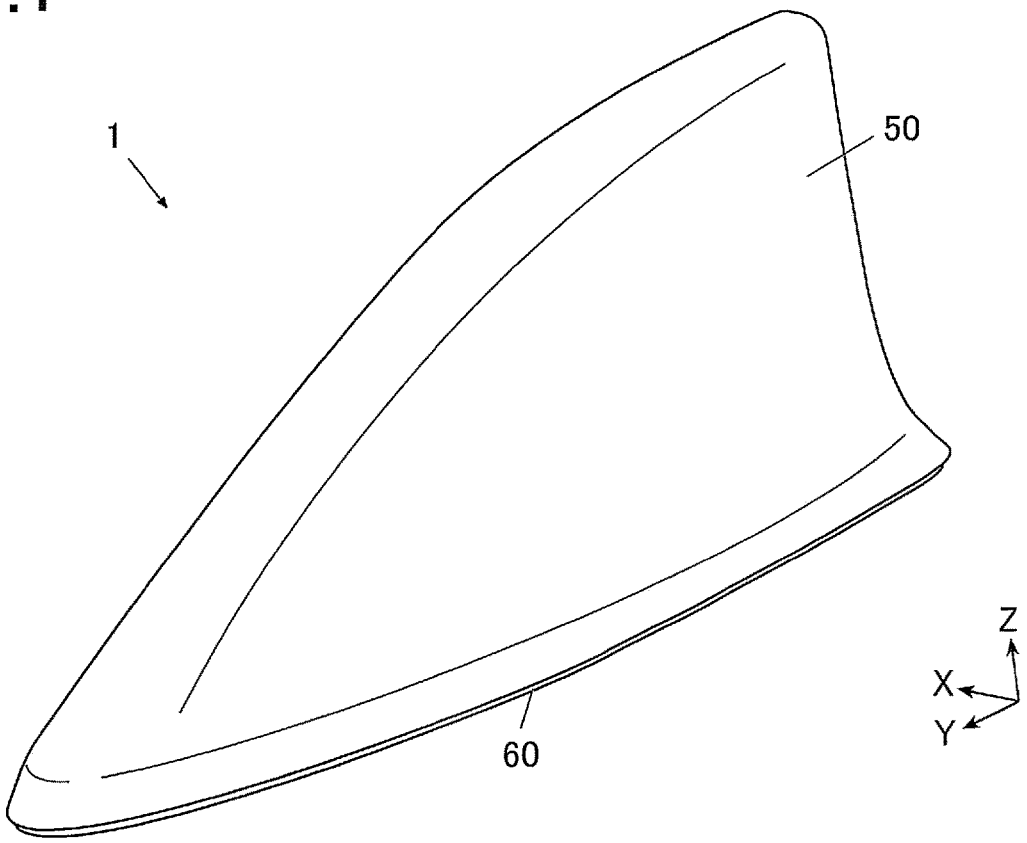
FIG. 1 is an external perspective view of an antenna device according to an embodiment of the present invention.
Figure 2:
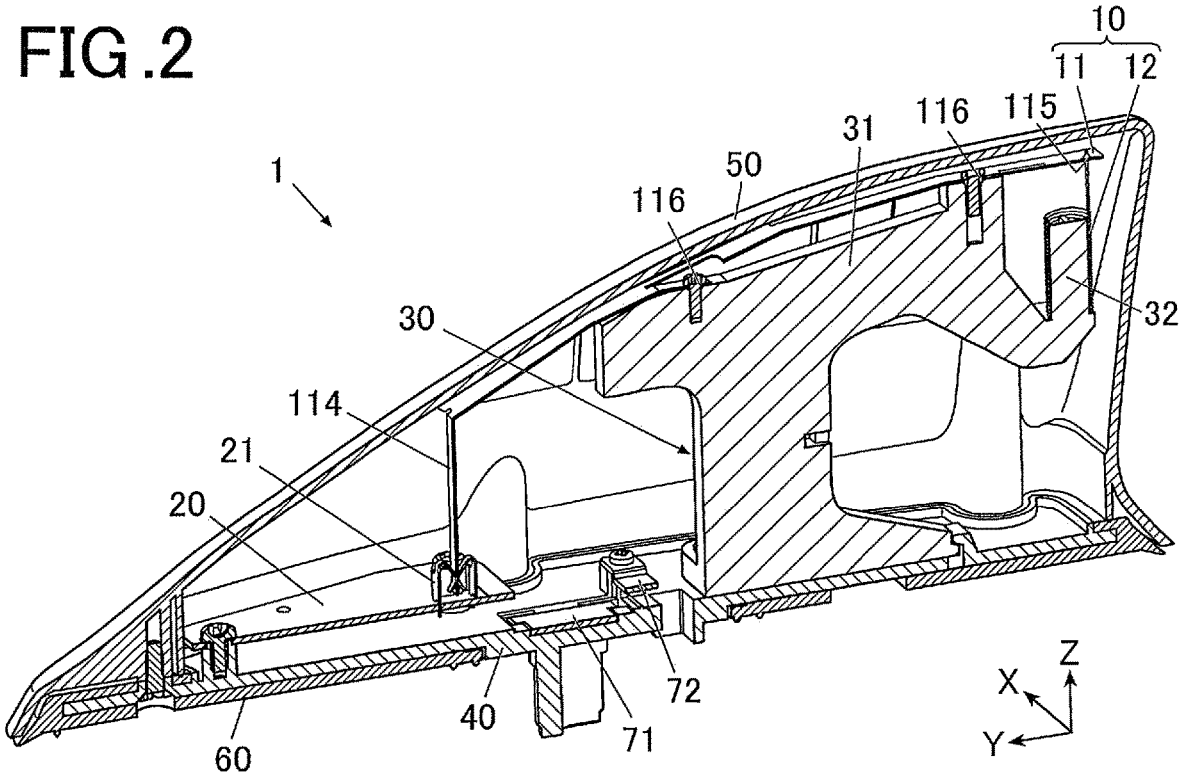
FIG. 2 is a cross-sectional view of the antenna device according to the embodiment of the invention.
Figure 3:
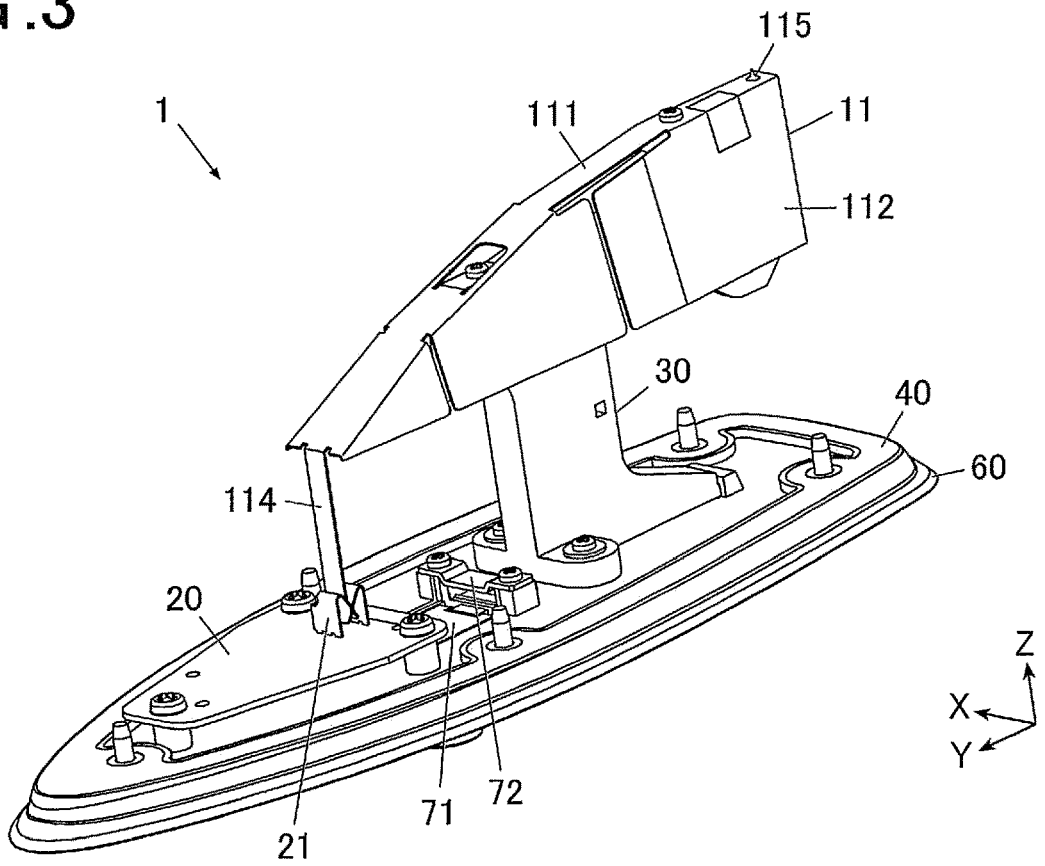
FIG. 3 is a perspective view of the antenna device according to the embodiment of the invention and illustrates the antenna device from which an antenna cover is removed.
Figure 4:
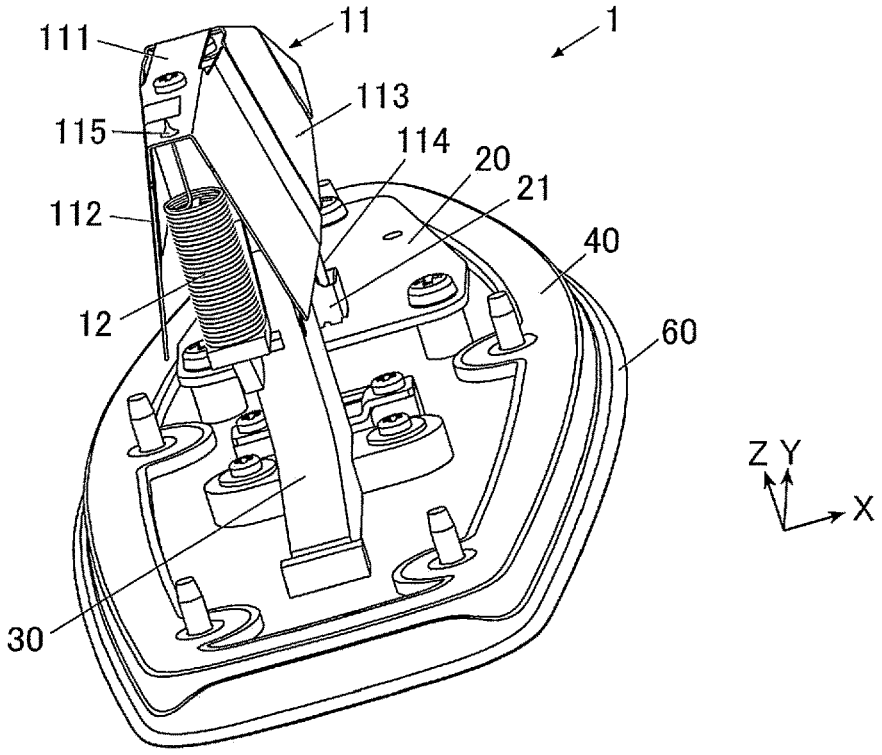
FIG. 4 is a perspective view of the antenna device according to the embodiment of the invention and illustrates the antenna device from a different direction from FIG. 3 and the antenna cover is removed.
Figure 5:
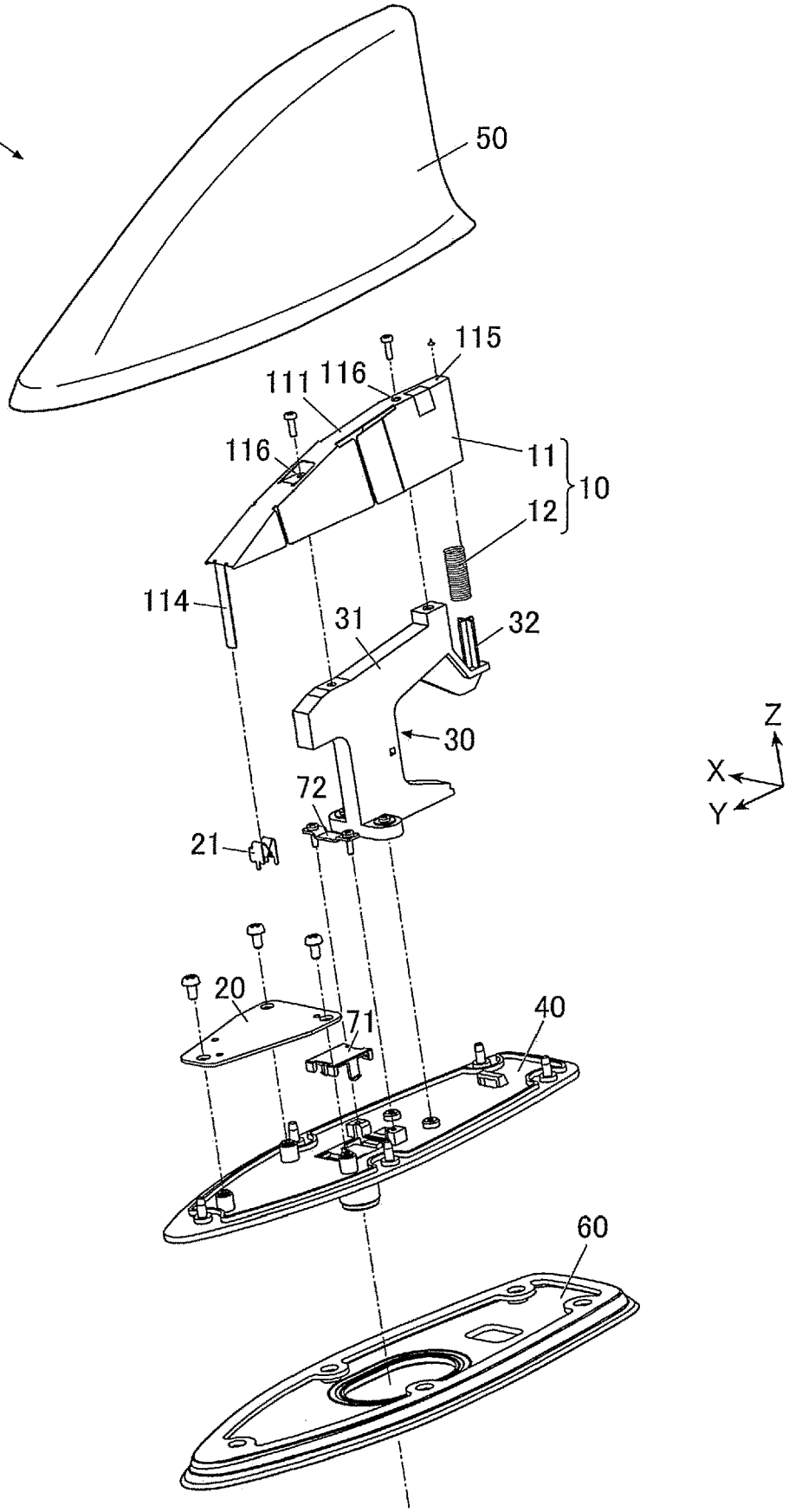
FIG. 5 is an exploded perspective view of the antenna device according to the embodiment of the invention.

Hereinafter, a preferred embodiment of the present invention will be described with the drawings. However, the scope of the invention is not limited to the disclosed embodiments.

An antenna device 1 according to the present embodiment is an exemplary automobile antenna device that can receive radiowaves at the frequency bands for AM/FM broadcasts and is fixed on a mount face of the roof of an automobile.

As illustrated in FIGS. 1 to 5, the antenna device 1 includes an antenna component 10, an amplifier board 20, an antenna holder 30, an antenna base 40, an antenna cover 50, a gasket 60, and other components, for example, a hook 71, a cable holder 72, and a bolt. In the drawing, the X axis indicates the lateral or right-left direction, the Y axis the longitudinal or front-back direction, and the Z axis the vertical direction. The antenna device 1 protrudes from the mounting face and has a height of 70 mm or less.

The antenna component 10 includes a metal plate 11 and a resonance point adjusting coil 12 having a first end connected to the metal plate 11.

The antenna cover 50 has a shape of a shark fin that is raised toward its rear portion.

The metal plate 11 has a top face 111, a left sidewall 112, a right sidewall 113, a connecting bar 114, a coil connecting hole 115, and a fixing slots 116, 116.

The top face 111 extends along the upper edge of the antenna cover 50 in the longitudinal direction.

The left sidewall 112 extends obliquely downward from the left edge of the top face 111 along the left face of the antenna cover 50.

The right sidewall 113 extends obliquely downward from the right edge of the top face 111 along the right face of the antenna cover 50.

The connecting bar 114 extends downward from the front edge of the top face 111. The connecting bar 114 is inserted into a connecting terminal 21 mounted to the amplifier board 20 to connect the antenna component 10 to the amplifier board 20. In this way, the resonance point adjusting coil 12 is connected to the input terminal of the amplifier board 20 via the metal plate 11. The connecting terminal 21 is composed of a pair of spring terminals holding and crimping the connecting bar 114 therebetween, and the connecting bar 114 can be readily connected to the connecting terminal 21 only by the insertion.

The coil connecting hole 115 is provided at the rear end of the top face 111. The resonance point adjusting coil 12 is inserted into the coil connecting hole 115 at the first end and is soldered. In this manner, the resonance point adjusting coil 12 has the first end connected to the metal plate 11 and a second end that is free or open.

The top face 111 has the pierced fixing slots 116, 116, as described above.

The amplifier board 20 is a circuit board provided with an amplifier to amplify AM/FM signals received by the antenna component 10. The amplifier board 20 is fixed on the top face of the antenna base 40. In the present embodiment, although the amplifier board 20 is disposed adjacent to the front end, the amplifier board 20 may be disposed in any position, for example, in the longitudinal center or adjacent to the rear end. The free selection of the position can be achieved by the position of the connecting terminal 21 and the bend or extension of the connecting bar 114.

The antenna holder 30 is an insulator holding the antenna component 10 and stands on the antenna base 40. The antenna holder 30 includes a metal plate holding block 31 on which an internal thread is provided. As illustrated, bolts are inserted into the fixing slots 116, 116, and the metal plate 11 is thereby fixed to the antenna holder 30.

The antenna holder 30 is provided with a coil holding block 32 for the resonance point adjusting coil 12. The coil holding block 32 extends rearward from the rear end of the metal plate holding block 31. The coil holding block 32 is disposed according to the position of the resonance point adjusting coil 12.

The mount angle of the resonance point adjusting coil 12 to the antenna component 10 in FIGS. 1 to 5 is 0°. The mount angle of the resonance point adjusting coil 12 is defined as 0° when the direction from the first end of the coil 12 to the second end along the central axis of the resonance point adjusting coil 12 is vertically downward.

Figure 8A:
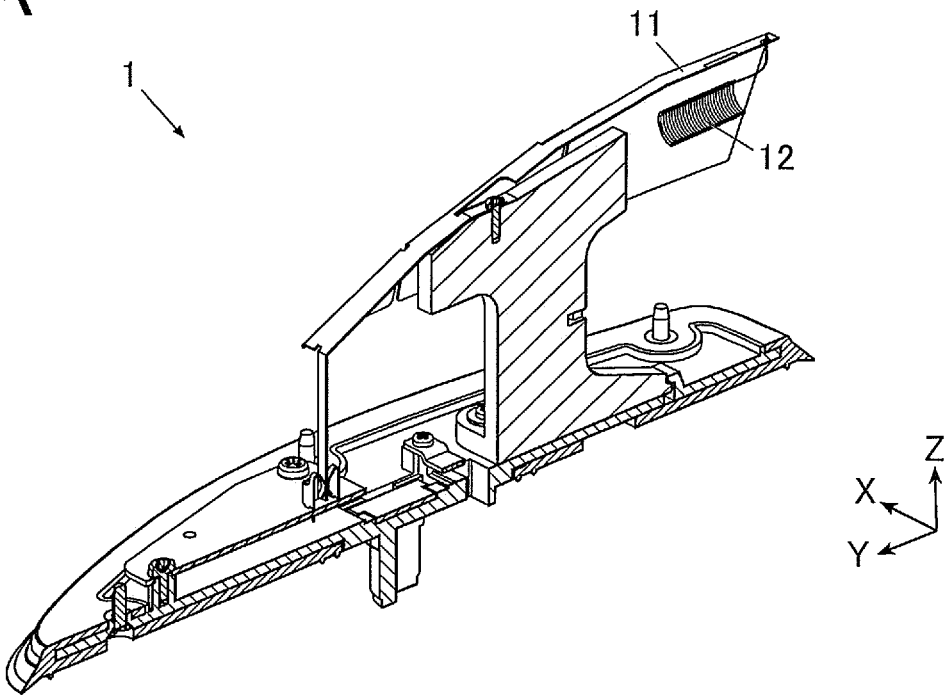
FIG. 8A is a cross-sectional view of an antenna device according to an embodiment of the invention and illustrates a coil mounted at another angle in the antenna device from which an antenna cover is removed.
Figure 8B:
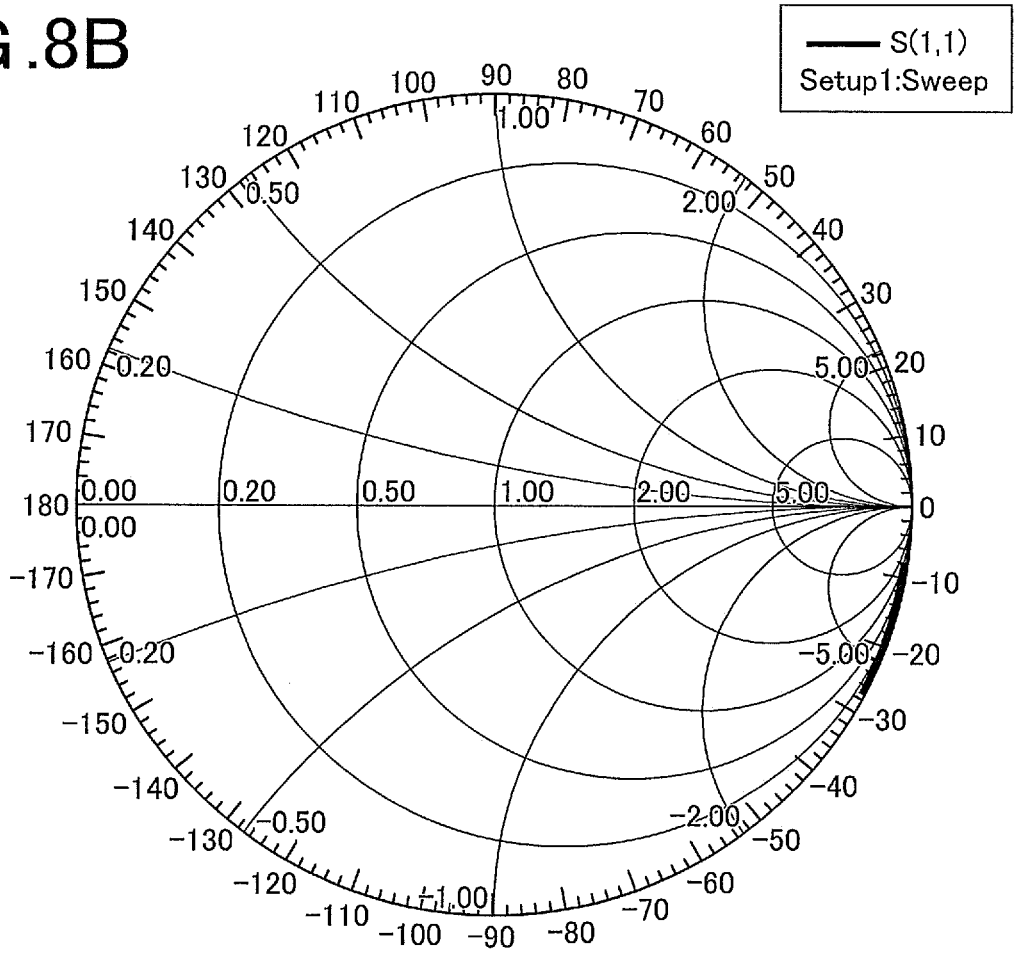
FIG. 8B is a Smith chart of the antenna device in FIG. 8A.
Figure 9A:
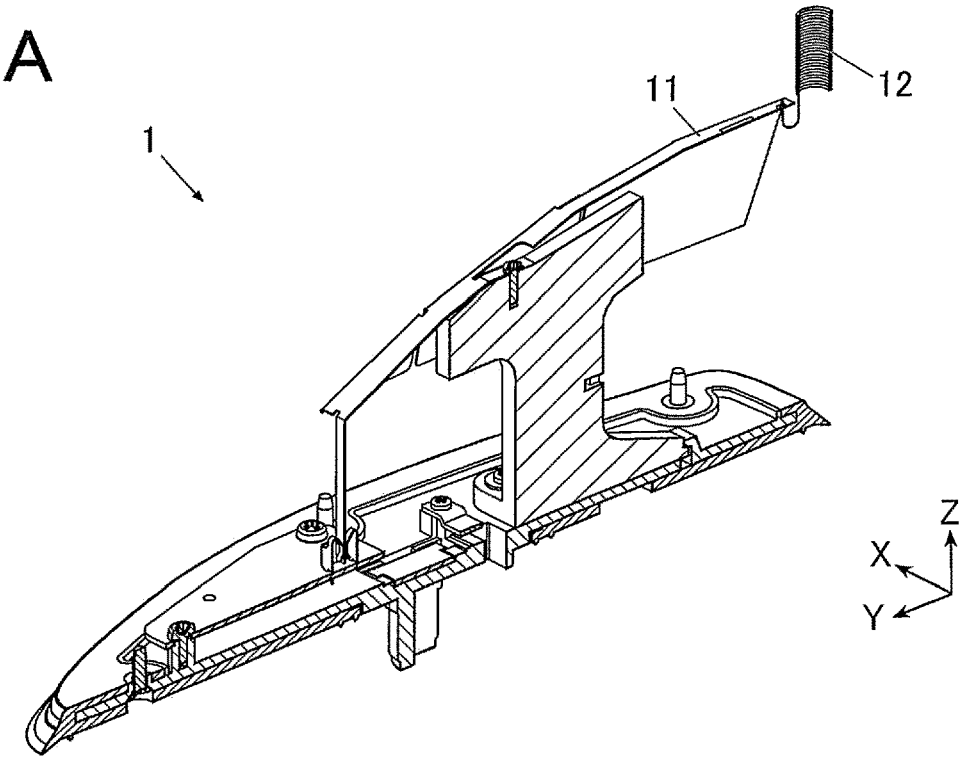
FIG. 9A is a cross-sectional view of an antenna device according to an embodiment of the invention and illustrates a coil mounted at still another angle in the antenna device from which an antenna cover is removed.

The angle from 0° in the rearward position is defined as a positive angle. The mount angle is 270° in FIG. 8A, 180° in FIG. 9A, 90° in FIG. 10A, and 270° in 11A. The configuration in FIG. 8A is different from that in FIG. 11A in that the resonance point adjusting coil 12 in FIG. 8A is disposed under the metal plate 11 whereas the resonance point adjusting coil 12 in FIG. 11A is disposed above the metal plate 11. Although not illustrated in FIGS. 8 to 11, the coil holding block 32 (and the entire antenna holder 30 and the antenna cover 50 if required) is disposed according to the position of the resonance point adjusting coil 12.

It should be noted that the metal plate 11 or the resonance point adjusting coil 12 may be appropriately varied so as to be held under the antenna cover 50. If both the metal plate 11 and the resonance point adjusting coil 12 are held under the antenna cover 50, the illustrated antenna holder 30 that is disposed under the antenna cover is not necessary.

The antenna base 40 has a hole through which a cable extends to the automobile or a protrusion, and is fixed to the mounting face. The gasket 60 is disposed between the antenna base 40 and the mounting face. The lower portion of the antenna cover 50 is fixed to the outer edge of the antenna base 40. The antenna base 40 and the antenna cover 50 accommodate, for example, the antenna component 10, the amplifier board 20, and the antenna holder 30.

Figure 7A:
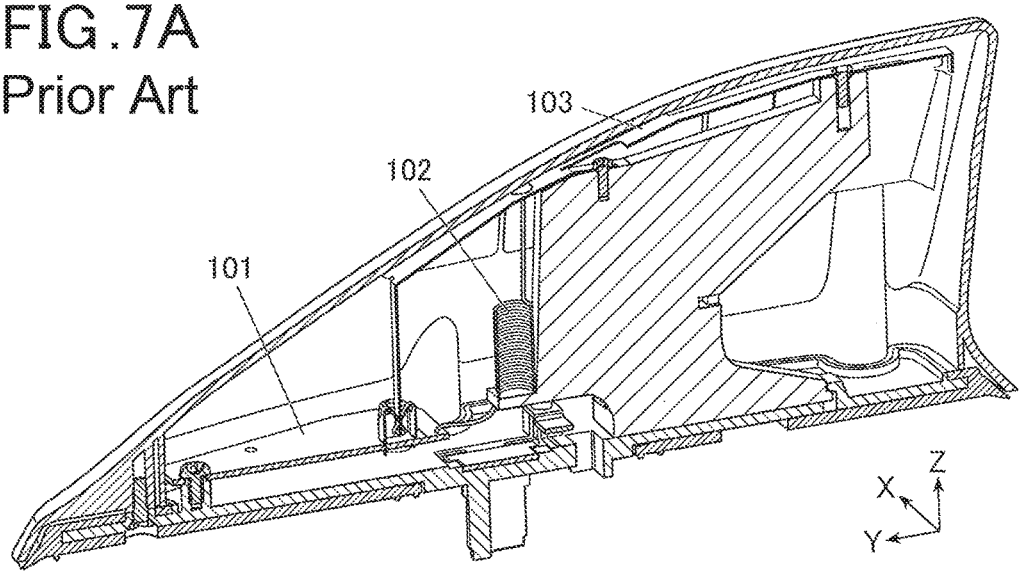
FIG.7A Prior Art
FIG. 7A is a cross-sectional view of a traditional antenna device.

FIG. 7A illustrates a traditional antenna device including a coil 102 connected to an amplifier board 101 at a first end and connected to a capacity hat 103 at a second end. The traditional antenna device is a comparative model.

The models in FIGS. 1 to 4 according to the present invention, the comparative model in FIG. 7A, and models in FIGS. 8A, 9A, 10A, and 11A according to the present invention are simulated. Smith charts are prepared as illustrated in FIGS. 6, 7B, 8B, 9B, 10B, and 11B.

Figure 6:
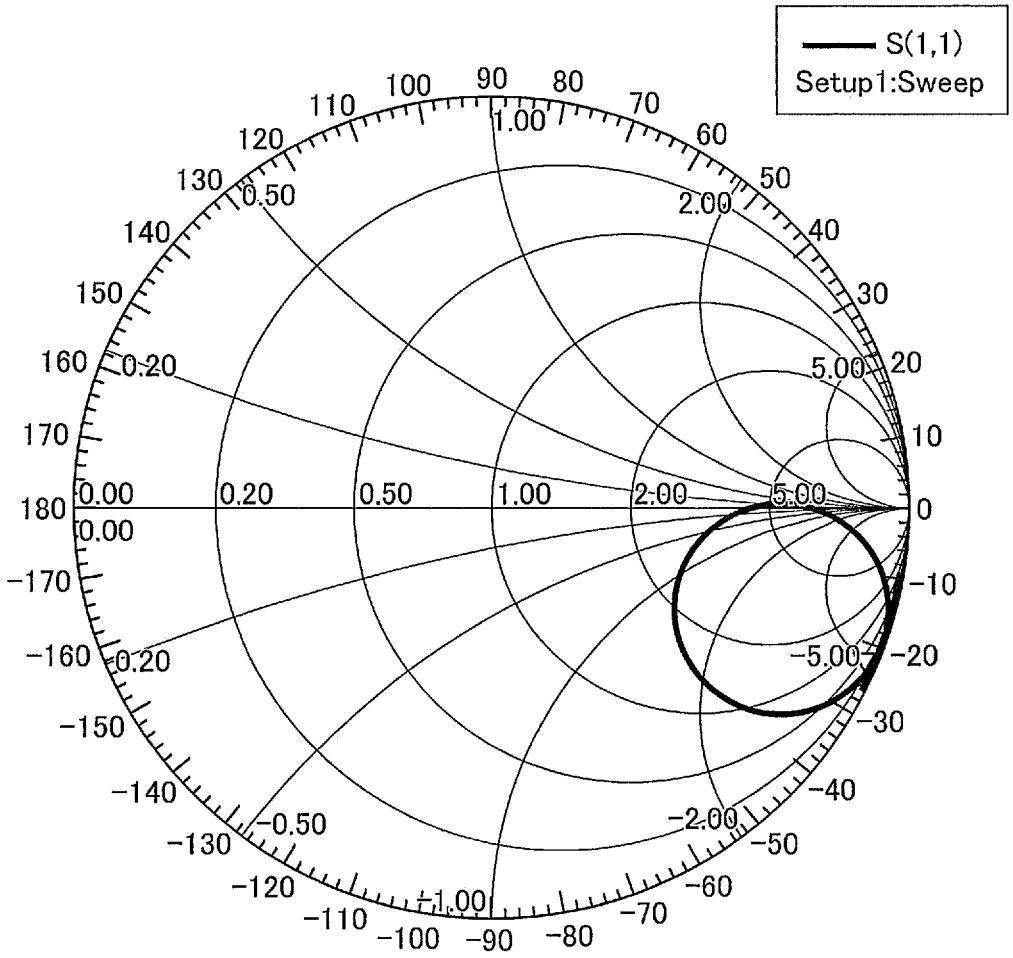
FIG. 6 is a Smith chart of the antenna device in FIGS. 1 to 4.
Figure 7B:
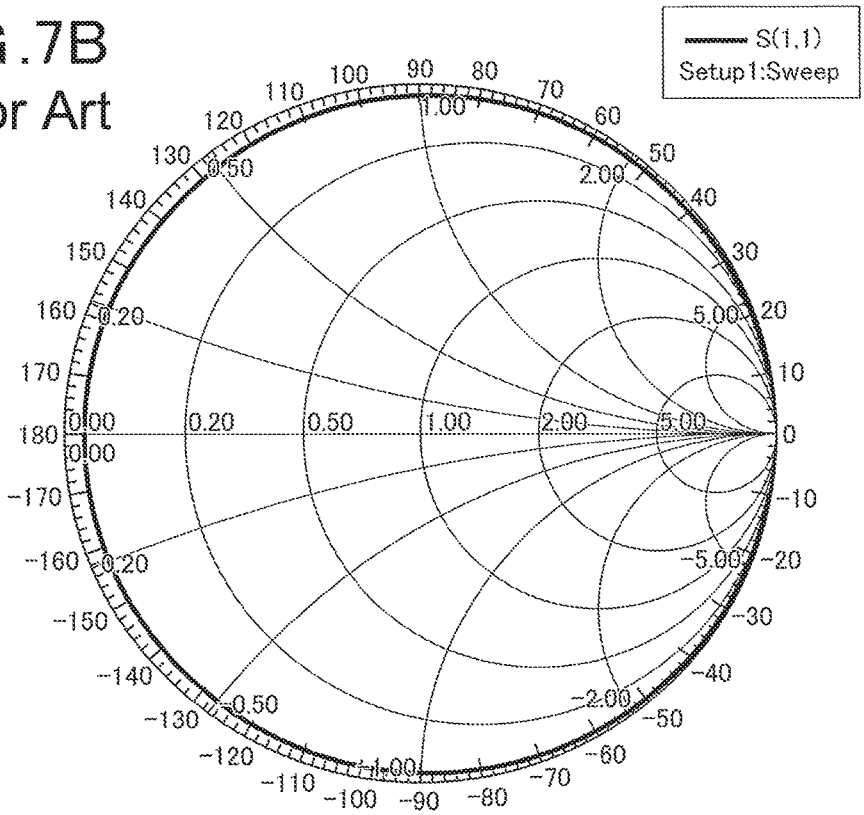
FIG.7B Prior Art
FIG. 7B is a Smith chart of the traditional antenna device in FIG. 7A.
Figure 9B:
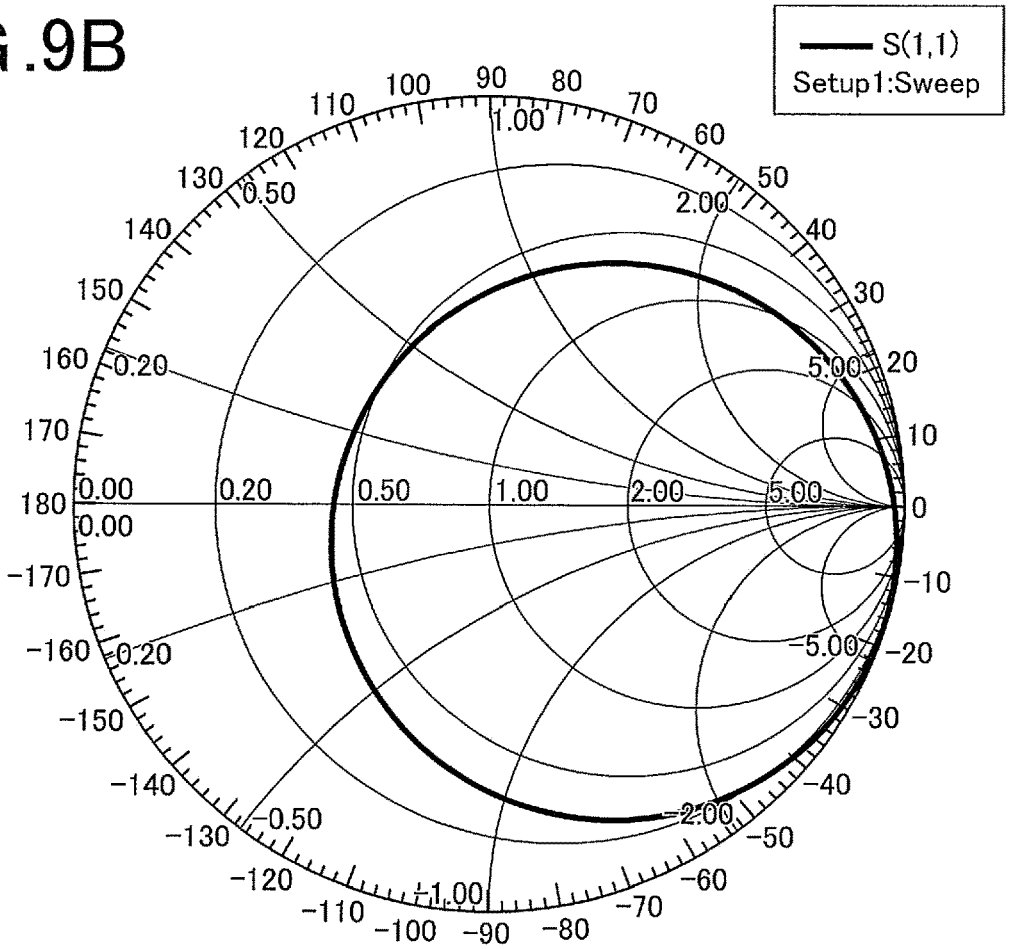
FIG. 9B is a Smith chart of the antenna device in FIG. 9A.
Figure 10A:
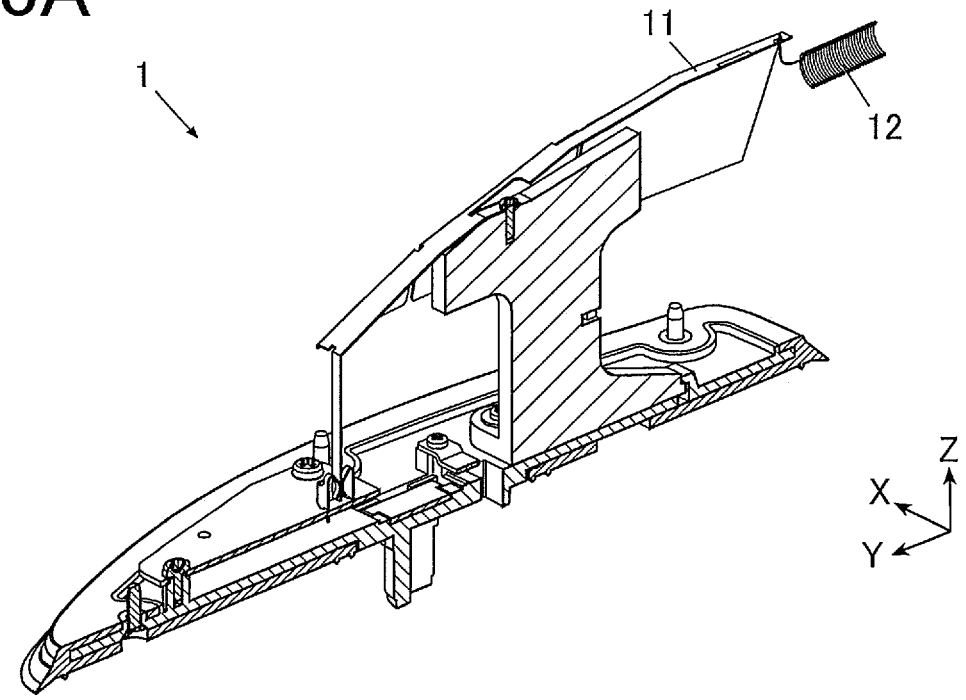
FIG. 10A is a cross-sectional view of an antenna device according to an embodiment of the invention and illustrates a coil mounted at still another angle in the antenna device from which an antenna cover is removed.
Figure 10B:
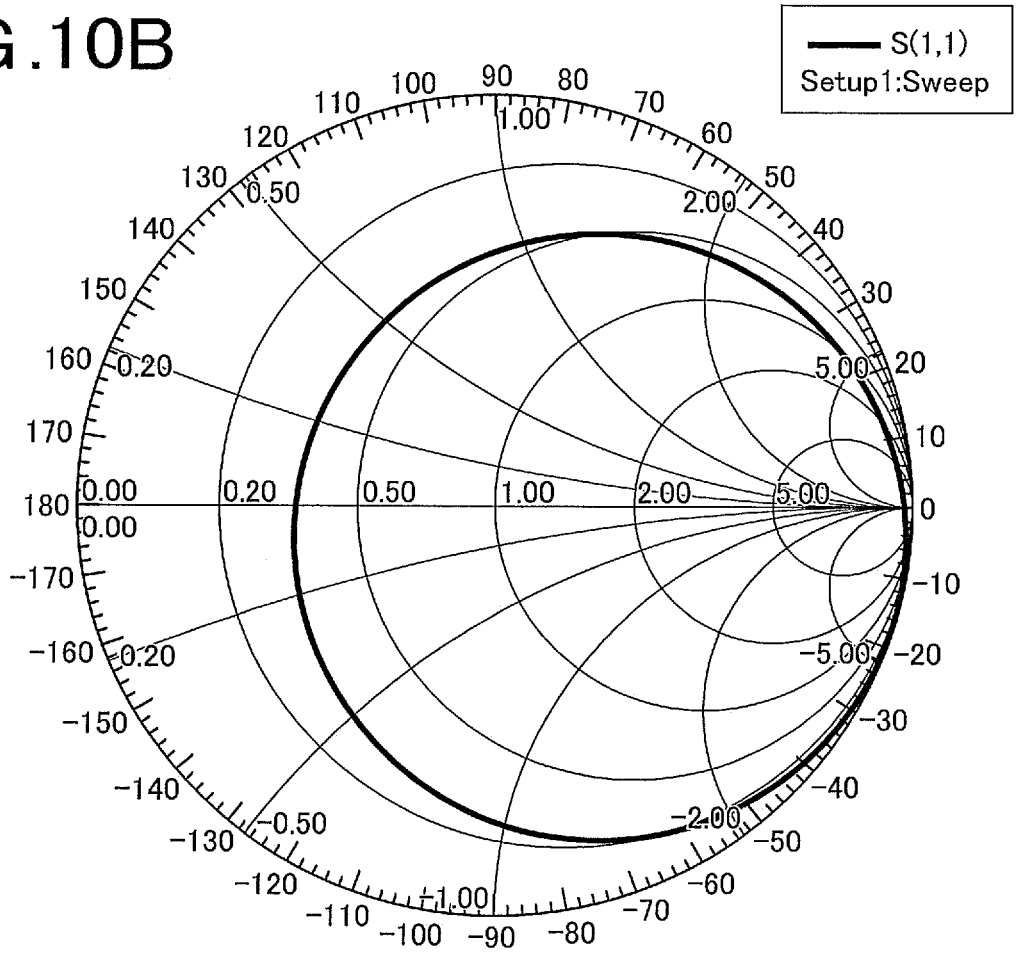
FIG. 10B is a Smith chart of the antenna device in FIG. 10A.
Figure 11A:
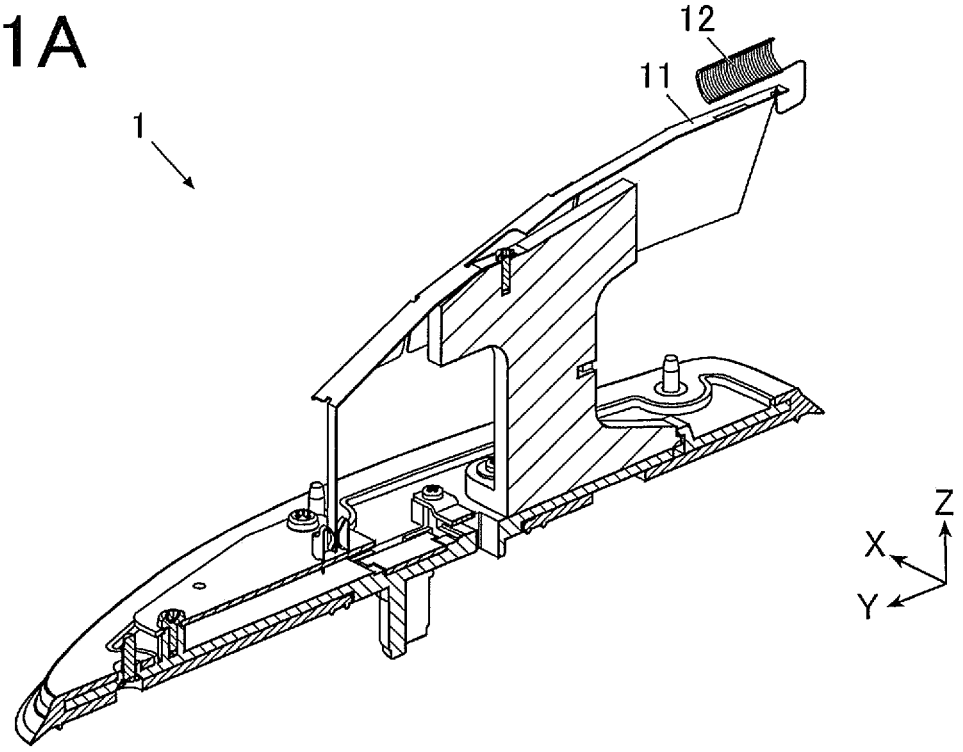
FIG. 11A is a cross-sectional view of an antenna device according to an embodiment of the invention and illustrates a coil mounted at still another angle in the antenna device from which an antenna cover is removed.
Figure 11B:
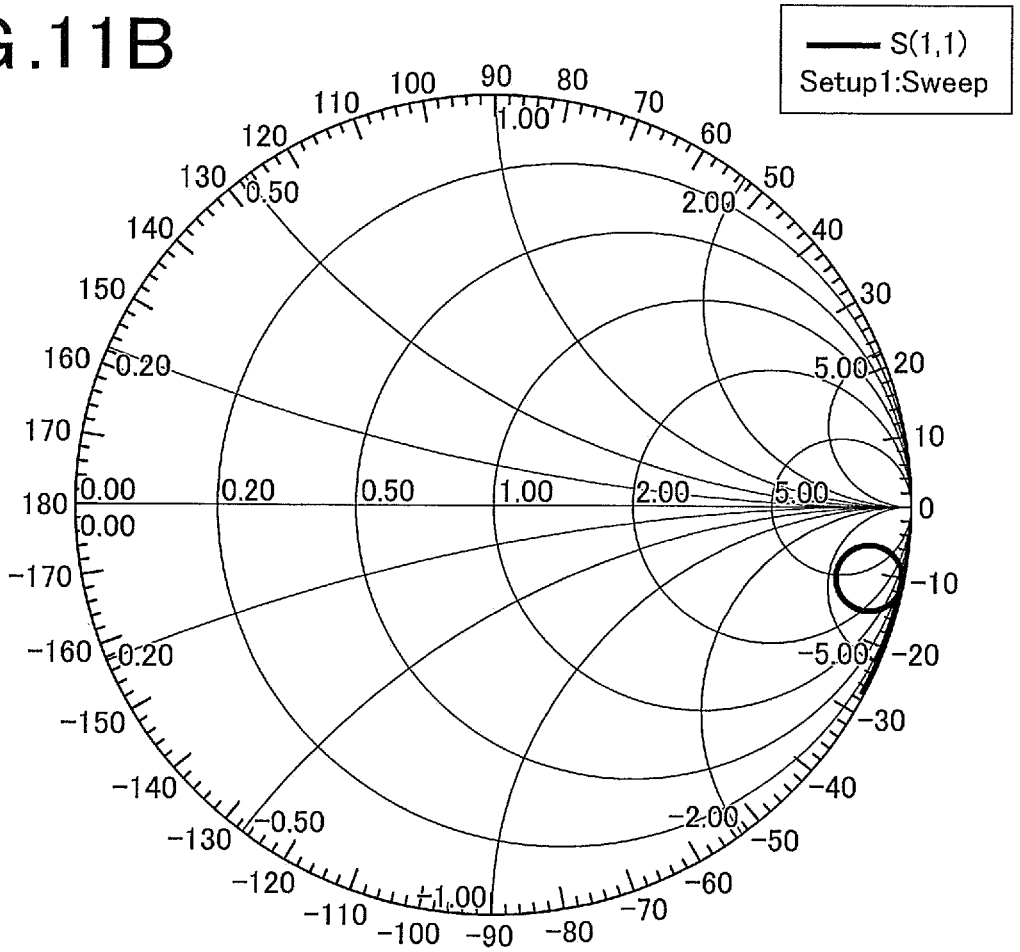
FIG. 11B is a Smith chart of the antenna device in FIG. 11A.

As apparent from the comparison of the model in FIG. 7B with those in FIGS. 6, 9B, and 10B, the models according to the present invention can more readily match impedances than the comparative model.

As apparent from FIGS. 6, 8B, 9B, 10B, and 11B illustrating the models according to the present invention, the antenna device 1 can adjust the impedance of the antenna component 10 by the mount angle of the resonance point adjusting coil 12.

In the comparative model in FIG. 7A, the impedance of the antenna component depends on the capacity hat 103 along the upper edge rather than the coil 102. The impedance can be adjusted only by a modification of the mount angle of the capacity hat 103. Since the capacity hat 103 has a large size, the angle cannot be readily modified. In the antenna device 1 according to the present embodiment, the impedance of the antenna component depends on the resonance point adjusting coil 12 at the upper end rather than the metal plate 11. The modification of the mount angle of the relatively small resonance point adjusting coil 12 enables the impedance to be adjusted.

Without limitation to the illustrations, the mount angle of the resonance point adjusting coil 12 can be selected from the range between 0° and 90°, the range between 90° and 180°, the range between 180° and 270°, and the range between 270° and 360°, and the impedance can be finely adjusted.

A method for manufacturing the antenna device 1 includes adjusting the mount angle of the resonance point adjusting coil 12 and adjusting the pitch of the resonance point adjusting coil 12, the number of windings, and the length of the wire according to the mount angle to adjust the impedance of the antenna component 10 to a desired level.

After the determination of the position and specification of the resonance point adjusting coil 12, the antenna holder 30 and the antenna cover 50 are produced and assembled into the antenna device.

In accordance with the antenna device 1 according to the present embodiment, the impedance of the antenna component 10 can be adjusted by the modification of the mount angle of the resonance point adjusting coil 12 of the antenna component 10 without a matching circuit.

In a traditional antenna device, the input impedance from an amplifier is adjusted by a matching circuit including a resistor in combination with a capacitor and an inductor and is matched with the impedance of the antenna component. In the antenna device 1 according to the present embodiment, the impedance can be adjusted also by the antenna component 10, and thus the adjustable range of the impedance is wide. The losses caused by the impedance mismatch between the antenna component and the amplifier can be reduced, and a high receiving sensitivity can be achieved.

The antenna device 1 according to the present embodiment does not require a matching circuit including a resistor in combination with a capacitor and an inductor on the amplifier board. Thus, the number of components and the production costs can be reduced.

In the antenna device 1 according to the present embodiment, the amplifier board 20, the metal plate 11, and the coil 12 are connected in sequence, and the impedance can be thereby enhanced compared to the traditional antenna device illustrated in FIG. 7A where an amplifier board, a coil, and a capacity hat are connected in sequence. In the antenna device 1 according to the embodiment, the resonance point adjusting coil 12 is soldered with the metal plate 11 at one end, and the connecting bar 114 of the metal plate 11 can be inserted into the connecting terminal 21. Thus, the assembly of the antenna device 1 is more ready than that of the traditional antenna device.

In the present embodiment, the antenna device for AM/FM broadcasting is exemplified. Alternatively, the size of the metal plate 11 and/or the position of the amplifier board 20 are varied, and thereby a composite antenna device can be achieved that includes, for example, a patch antenna, such as SXM antenna or GNSS antenna, and an on-board antenna or a monopole antenna, such as DAB antenna or telecommunication antenna.

The antenna device described in the present embodiment is of a shark fin type mounted on a roof. Alternatively, the antenna device according to the present invention can be mounted on, for example, a spoiler, side mirror, wing mirror, or dash board.

It should be noted that the amplifier board 20 can be connected to the metal plate 11 without intervention of the connecting terminal to be directly powered.

The resonance point adjusting coil may be of a helical type, a zigzagged type, a meander type, or a looped type.

What is claimed is:

1. A shark fin type antenna device mounted to an automobile, comprising:

an antenna component; and an amplifier board provided with an amplifier to amplify signals received by the antenna component, wherein the antenna component comprises a metal plate and a resonance point adjusting coil mounted to the metal plate, the resonance point adjusting coil having a first end connected to the metal plate and a second end that is open, and the resonance point adjusting coil being connected to an input terminal of the amplifier board at the first end via the metal plate, wherein an impedance of the antenna component changes in accordance with a selection of a mount angle of the resonance point adjusting coil mounted to the metal plate, and wherein the mount angle of the resonance point adjusting coil is fixed in the shark fin type antenna device after the selection of the mount angle such that the resonance point adjusting coil cannot be tiltably adjusted.

2. The antenna device according to claim 1, wherein a direction from the first end of the resonance point adjusting coil to the second end along a central axis of the resonance point adjusting coil is vertically downward.

3. The antenna device according to claim 1, wherein the resonance point adjusting coil is mounted at an angle of 90° where a mount angle of the resonance point adjusting coil is defined as 0° when a direction from the first end of the resonance point adjusting coil to the second end along a central axis of the resonance point adjusting coil is vertically downward.

4. A method for manufacturing the antenna device according to claim 1, the method comprising:

adjusting the mount angle of the resonance point adjusting coil; and adjusting a pitch and a number of windings and a length of a wire of the resonance point adjusting coil according to the mount angle to adjust the impedance of the antenna component to a desired level.

* * * * *